US009562366B2

(12) United States Patent
Munsey

(10) Patent No.: US 9,562,366 B2
(45) Date of Patent: Feb. 7, 2017

(54) SWIMMING POOL CLEANING SYSTEM

(71) Applicant: Michael Munsey, Spring, TX (US)

(72) Inventor: Michael Munsey, Spring, TX (US)

( * ) Notice: Subject to any disclaimer, the term of this patent is extended or adjusted under 35 U.S.C. 154(b) by 0 days.

(21) Appl. No.: 14/703,031

(22) Filed: May 4, 2015

(65) Prior Publication Data

US 2016/0017623 A1 Jan. 21, 2016

Related U.S. Application Data

(60) Provisional application No. 62/026,357, filed on Jul. 18, 2014.

(51) Int. Cl.
*A47L 13/26* (2006.01)
*E04H 4/16* (2006.01)
*B05C 11/04* (2006.01)

(52) U.S. Cl.
CPC ..... *E04H 4/1609* (2013.01); *B05C 11/048* (2013.01)

(58) Field of Classification Search
CPC ..... E04H 4/1609; B05C 11/048
USPC ..... 401/139, 140; 15/118, 236.05–236.09, 15/250.01, 250.03, 250.04
See application file for complete search history.

(56) References Cited

U.S. PATENT DOCUMENTS 3,046,583 A 7/1962 Drennan
4,637,087 A 1/1987 Feinberg
4,692,956 A * 9/1987 Kassis ..... E04H 4/1636 15/1.7
4,745,653 A * 5/1988 Bliznak ..... B60S 1/524 15/250.04
5,044,034 A 9/1991 Iannucci
5,915,431 A * 6/1999 Doussan ..... E04H 4/1609 15/1.7
6,604,254 B1 * 8/2003 Powell ..... A46B 11/063 15/1.7
7,481,594 B2 * 1/2009 Martin ..... A46B 11/0006 401/268
8,185,990 B1 5/2012 Newville
2005/0198751 A1 9/2005 Navratil
2012/0251223 A1 * 10/2012 Su ..... A46B 5/0095 401/282

* cited by examiner

*Primary Examiner* — Jennifer C Chiang
(74) *Attorney, Agent, or Firm* — Global Intellectual Property Agency, LLC; Daniel Boudwin

(57) ABSTRACT

A swimming pool cleaning system for removing stains and deposits on the bottom and walls of a swimming pool. The cleaning system includes a cleaning tool having an elongated handle pivotally secured to a tool head, wherein the tool head dispenses a cleaning solution for removing stains and deposits. The tool head may also include an absorbent or sponge-like material thereon and one or more scrapers to help remove deposits. The tool head is in fluid communication with a container in which a cleaning solution can be stored. The container includes a pump thereon for allowing the user to selectively deliver the cleaning solution to the cleaning tool. Thus, the cleaning system allows a user to more easily remove stains and deposits from the walls and bottom of a pool.

6 Claims, 3 Drawing Sheets

SWIMMING POOL CLEANING SYSTEM

CROSS REFERENCE TO RELATED APPLICATION

This application claims the benefit of U.S. Provisional Application No. 62/026,357 filed on Jul. 18, 2014. The above identified patent application is herein incorporated by reference in its entirety to provide continuity of disclosure.

BACKGROUND OF THE INVENTION

1. Field of the Invention

The present invention relates to a swimming pool cleaning system. More specifically, the present invention provides a cleaning tool adapted to dispense a cleaning solution stored within a container that is in fluid communication with the cleaning tool, wherein the cleaning solution can be dispensed by operation of a pump disposed on the container.

Stains and deposits often accumulate on the bottom and sidewalls of swimming pools. The stains and deposits negatively impact the appearance of the swimming pool and can become increasingly difficult to remove over time. Thus, it is necessary to have a pool cleaned regularly in order to eliminate any deposits or stains thereon. In order to clean the swimming pool, the pool owner may have to drain the pool so that the walls and bottom of the pool can be more easily cleaned. However, draining the pool, cleaning the surfaces thereof, and then refilling the pool can be a costly and time consuming process. Alternatively, if the pool owner does not wish to drain the pool, scuba gear can be used in order to help a user manually clean the walls and bottom of the pool while it is filled with water. Again, this process can be time consuming and expensive. Thus, a device for allowing the walls and bottom of a pool to be more easily cleaned is desired.

2. Description of the Prior Art

Devices have been disclosed in the prior art that relate to swimming pool cleaning devices. These include devices that have been patented and published in patent application publications. These devices generally relate to brushes and vacuum cleaning devices for cleaning the bottom and walls of a swimming pool. The following is a list of devices deemed most relevant to the present disclosure, which are herein described for the purposes of highlighting and differentiating the unique aspects of the present invention, and further highlighting the drawbacks existing in the prior art.

Some devices, such as U.S. Published Patent Application Number 2005/0198751, U.S. Pat. No. 5,044,034, U.S. Pat. No. 3,046,583 disclose vacuum cleaning devices for cleaning the bottom and walls of a swimming pool. Other patents, such as U.S. Pat. No. 8,185,990 and U.S. Pat. No. 4,637,087 disclose swimming pool cleaning brushes having attachments thereon for facilitating moving a cleaning brush in the water.

These prior art devices have several known drawbacks. The devices in the prior art fail to disclose cleaning devices that are adapted to dispense a cleaning solution. As a result, the cleaning devices simply vacuum and filter the pool water, or scrape dirt and debris from the pool surfaces. Similarly, the prior art does not disclose a device that can supply a cleaning solution from an external container. Thus, the devices in the prior art are not suited for removing stains and deposits on the bottom and walls of a pool, and are simply used to clean dirt and debris from the swimming pool.

In light of the devices disclosed in the prior art, it is submitted that the present invention substantially diverges in design elements from the prior art and consequently it is clear that there is a need in the art for an improvement to existing swimming pool cleaning devices. In this regard, the instant invention substantially fulfills the above identified needs.

SUMMARY OF THE INVENTION

In view of the foregoing disadvantages inherent in the known types of swimming pool cleaning systems now present in the prior art, the present invention provides a new swimming pool cleaning system wherein the same can be utilized for providing convenience for the user when removing stains and deposits from the bottom and walls of a swimming pool.

It is therefore an object of the present invention to provide a new and improved swimming pool cleaning system that has all of the advantages of the prior art and none of the disadvantages.

It is another object of the present invention to provide a swimming pool cleaning system comprising a cleaning tool with an elongated handle and a tool head adapted to dispense a cleaning solution.

Another object of the present invention is to provide a swimming pool cleaning system comprising an elongated handle pivotally secured to a tool head so that the tool head may be pivoted in various orientations.

Yet another object of the present invention is to provide a swimming pool cleaning system comprising a container in which cleaning solution can be stored, wherein the container includes a hand pump for delivering cleaning solution to the cleaning tool.

Another object of the present invention is to provide a swimming pool cleaning system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
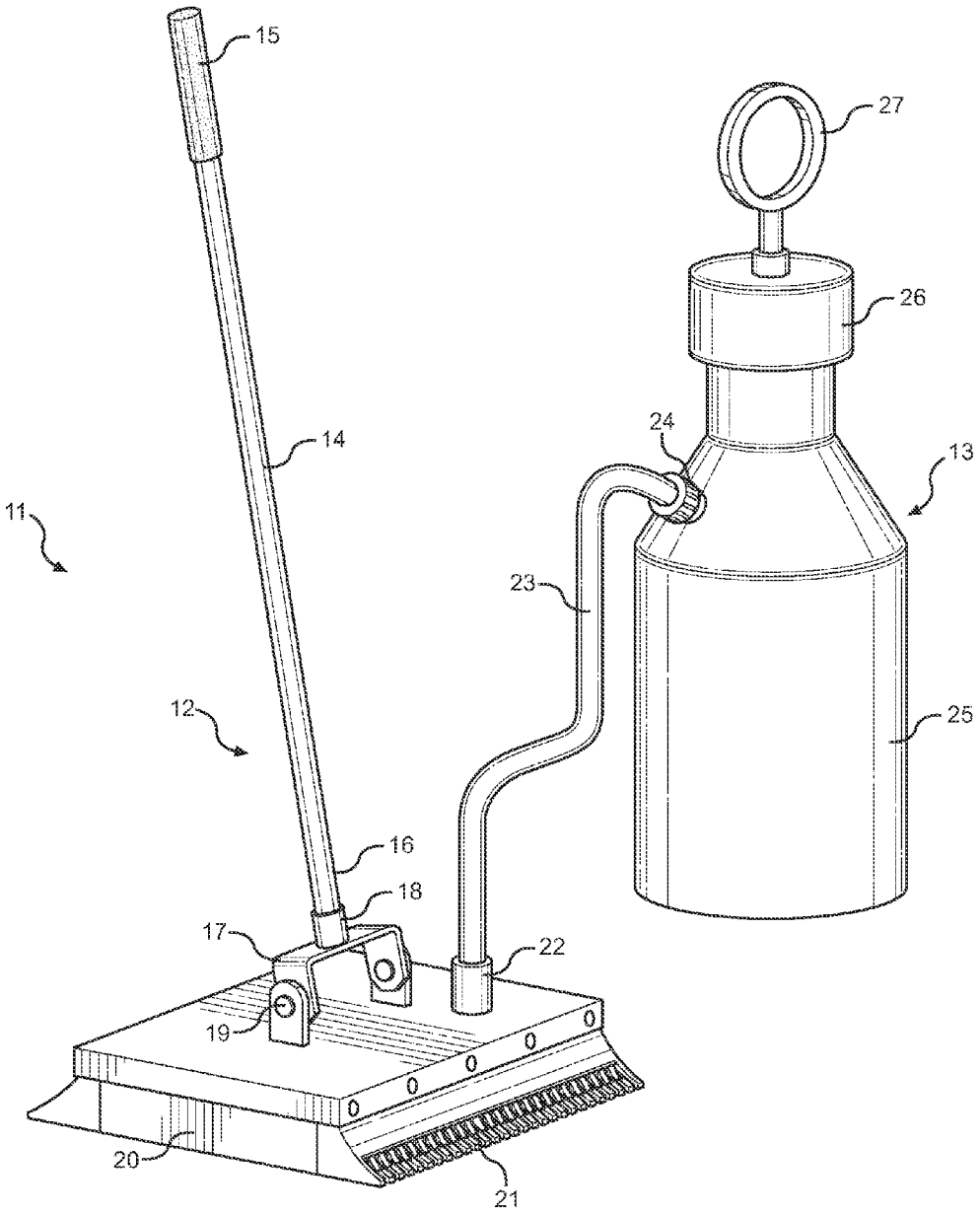
FIG. 1 shows a perspective view of the swimming pool cleaning system.

Reference is made herein to the attached drawings. Like reference numerals are used throughout the drawings to depict like or similar elements of the swimming pool cleaning device. For the purposes of presenting a brief and clear description of the present invention, the preferred embodiment will be discussed as used for removing stains and deposits on the bottom and walls of a swimming pool. The figures are intended for representative purposes only and should not be considered to be limiting in any respect.

Referring now to FIG. 1, there is shown a perspective view of the swimming pool cleaning system of the present invention. The present invention provides a swimming pool cleaning system 11 comprising a cleaning tool 12 and a cleaning solution container 13. The cleaning tool 12 comprises an elongated handle 15 having a cleaning head 20 on a second end 16 thereof. The cleaning head 20 is pivotally attached to the elongated handle 15 so that the cleaning head 20 can be disposed in various orientations. The cleaning head 20 is adapted to dispense a cleaning solution and includes a port 22 thereon for receiving cleaning solution. The cleaning tool 12 is adapted to dispense the cleaning solution so that the cleaning tool 12 can be used to scrub or wash a surface of a swimming pool, such as the bottom or wall thereof.

An elongated tube 23 can be used to place the cleaning tool 12 and container 13 in fluid communication with one another. The container 13 includes a container body 25 having a port 24 thereon. A first end of the elongated tube 23 can be secured to the port 22 on the cleaning tool 12 and a second end of the elongated tube can be secured to the port 24 on the container 13. The elongated tube 23 can be removably secured via a press fit or a threaded connection with the ports 22, 24. In this way, the container 13 can be used to supply a cleaning solution to the cleaning tool 12 of the present invention.

Figure 2:
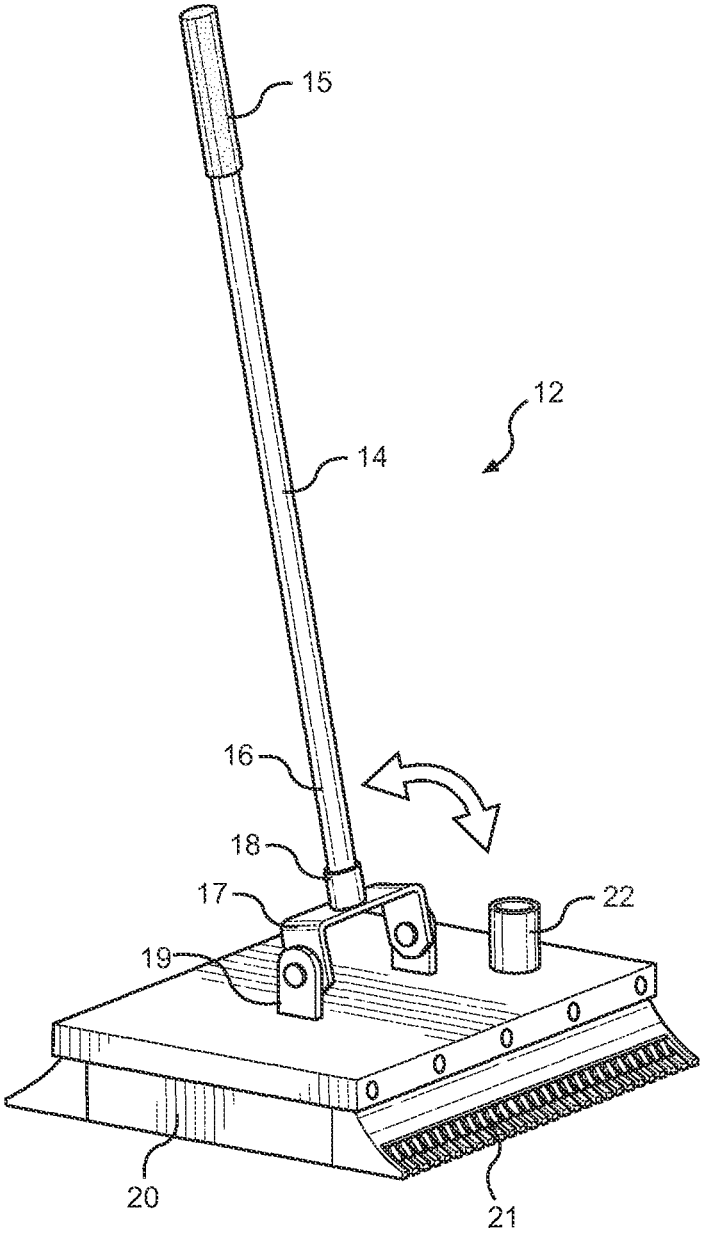
FIG. 2 shows a perspective view of the swimming pool cleaning tool.

Referring now to FIG. 2, there is shown a perspective view of the cleaning tool of the present invention. The cleaning tool 12 comprises an elongated handle 14 having a first end 15 for a user to grip, and a second end 16 pivotally connected to a cleaning head 20. A bracket 17 includes a sleeve 18 thereon in which the second end 16 of the elongated handle 14 can be inserted and secured by any suitable fastener, such as adhesives, screws, or bolts, among others. The bracket 17 is pivotally attached to the cleaning head 20 by means of a hinge 19. In this way, the elongated handle 14 can pivot in a vertical plane so that the cleaning tool can be easily used on slopes or inclines, and on the rounded interior corners of a swimming pool.

The cleaning head 20 is substantially rectangular and includes a first end opposite a second end. Each end preferably includes a scraper 21 thereon. The scraper 21 is adapted to be used to help remove stains or deposits on the pool surfaces. The scraper 21 includes a plurality of teeth arranged in a row and separated by a fixed interval. Each end of the cleaning head 20 includes a scraper 21 thereon.

Figure 3:
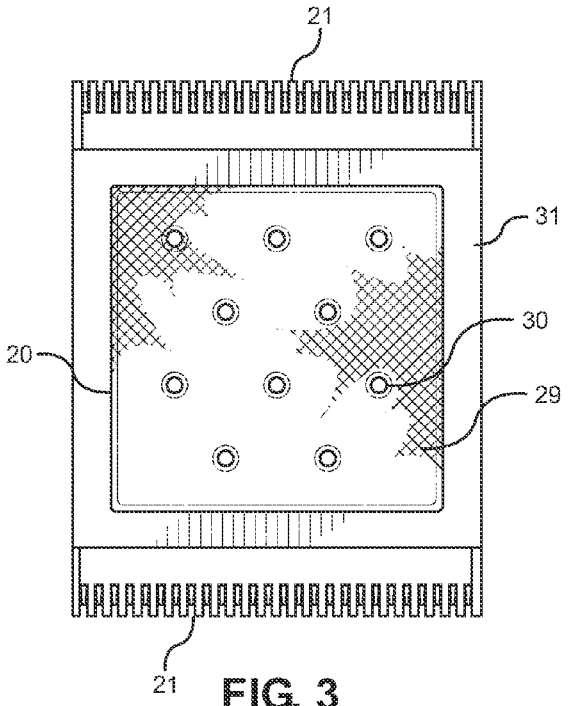
FIG. 3 shows an underside view of the swimming pool cleaning tool.

Referring now to FIG. 3, there is shown an underside view of the swimming pool cleaning tool. The bottom 31 of the cleaning head 20 includes scrapers 21 disposed on opposing sides of the cleaning head 20, and further includes means for dispensing a cleaning solution, such as one or more apertures 30. Further, the bottom 31 may include an absorbent or sponge-like material 29 disposed centrally thereon that can be saturated with the cleaning solution. The sponge-like material 29 can be disposed around the apertures 30 so that when the solution is dispensed through the apertures 30, the solution saturates the sponge-like material 29. Alternatively, the sponge-like material 29 may cover the apertures 30 so that the cleaning solution is fed directly to the sponge-like material 29.

The cleaning head 20 further includes at least one port 22 for receiving a cleaning solution and for supplying the cleaning solution to the dispensing means thereon. The port 22 is in fluid communication with the apertures on the bottom surface of the cleaning head 20. Thus, fluid supplied through the port 22 is fed to the apertures on the bottom surface of the cleaning head. An elongated, flexible tube 23 can be secured at a first end to the port 22 and can be secured at a second end to a port on a container having cleaning solution therein. In this way, the cleaning head can supply cleaning solution to the cleaning head 20 from a larger container.

Figure 4:
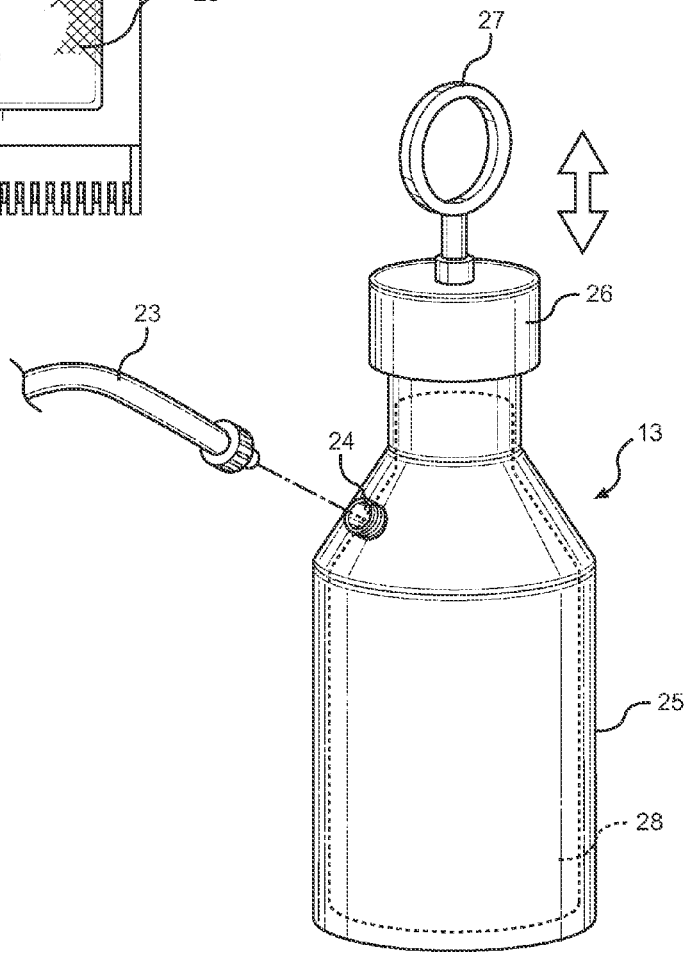
FIG. 4 shows a perspective view of the container of the swimming pool cleaning system.

Referring now to FIG. 4, there is shown a perspective view of the container of the swimming pool cleaning system. The container 13 includes a hollow interior volume 28 adapted to store a cleaning solution therein, such as hydrochloric acid or other pool cleaner. The container 13 preferably includes a cylindrical body 25 having a tapered upper end. The upper end of the container 13 can include a pump 26 thereon. The pump 26 is adapted to force the cleaning solution held within the container 13 into the elongated tube 23 so that it can be supplied to the cleaning head of the cleaning tool. Preferably, the pump 26 is a hand-operated pump with a handle 27 that can be actuated by the user, so that the user can selectively dispense cleaning solution from the container 13. However, in alternate embodiments, electronic pumps can be used for dispensing the cleaning solution within the container.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning tool, comprising:

an elongated handle having a first end and a second end, wherein said second end includes a cleaning head thereon;

the cleaning head comprising a top surface, a bottom surface, and a first side opposite and substantially parallel to a second side;

the first side and the second side each comprising a plurality of teeth arranged in a row and separated at a fixed interval;

said cleaning head comprising a port disposed on the top surface and adapted to receive a cleaning solution therein;

one or more apertures disposed on the bottom surface of said cleaning head that are in fluid communication with said port and adapted to dispense said cleaning solution;

the one or more apertures situated between the plurality of teeth of the first side and the plurality of teeth of the second side.

2. The cleaning tool of claim 1, wherein said second end of said elongated handle is connected to a bracket that is pivotally connected to said cleaning head by means of a hinge.

3. The cleaning tool of claim 1, further comprising a container in fluid communication with said cleaning head via an elongated tube removably connected to a port on said container and to said port on said cleaning head.

4. The cleaning tool of claim 1, wherein said container further includes a pump thereon for distributing said cleaning solution held therein through said elongated tube and to said cleaning head.

5. The cleaning tool of claim 1, wherein said container is substantially cylindrical and includes a tapered upper end.

6. The cleaning tool of claim 1, wherein said cleaning head includes an absorbent material thereon.

* * * * *